US008333443B1

(12) United States Patent
Abed

(10) Patent No.: US 8,333,443 B1
(45) Date of Patent: Dec. 18, 2012

(54) COMPACT COMPUTER STATION HOUSING

(76) Inventor: Skip H. Abed, Santa Barbara, CA (US)

( * ) Notice: Subject to any disclaimer, the term of this patent is extended or adjusted under 35 U.S.C. 154(b) by 215 days.

(21) Appl. No.: 12/910,562

(22) Filed: Oct. 22, 2010

(51) Int. Cl.
*A47B 95/02* (2006.01)
*A47B 67/02* (2006.01)

(52) U.S. Cl. ..... 312/223.3; 312/248; 312/244

(58) Field of Classification Search ..... 312/223.3, 312/242–248; 108/25–26.2
See application file for complete search history.

(56) References Cited

U.S. PATENT DOCUMENTS

| | | | | |
|---|---|---|---|---|
| 893,694 | A * | 7/1908 | Allenson | 312/243 |
| 1,314,628 | A * | 9/1919 | Willman | 312/29 |
| 2,662,989 | A * | 12/1953 | Thatcher | 312/351.6 |
| 2,876,542 | A * | 3/1959 | Breus | 433/77 |
| 3,247,332 | A * | 4/1966 | McHugh | 379/453 |
| 3,251,638 | A * | 5/1966 | Schwartz | 312/244 |
| 3,566,882 | A * | 3/1971 | Schroeder | 131/234 |
| 4,131,327 | A * | 12/1978 | Marshall et al. | 312/241 |
| 4,640,199 | A * | 2/1987 | Zigman | 108/6 |
| 4,852,500 | A * | 8/1989 | Ryburg et al. | 108/105 |
| D310,068 | S * | 8/1990 | Schroter | D14/340 |
| 5,013,103 | A * | 5/1991 | Addison | 312/249.12 |
| 5,080,452 | A * | 1/1992 | Tuckman | 312/242 |
| 5,623,881 | A * | 4/1997 | Huang | 108/50.01 |
| 5,680,820 | A * | 10/1997 | Randolph | 108/25 |
| 5,733,025 | A * | 3/1998 | Jesse, Sr. | 312/223.3 |
| 5,931,103 | A * | 8/1999 | Huang | 108/50.02 |
| 6,029,580 | A | 2/2000 | Alfonso et al. | |
| 6,102,218 | A | 8/2000 | Alfonso et al. | |
| 6,529,381 | B1 | 3/2003 | Schoenfish | |
| 7,278,644 | B2 * | 10/2007 | Villarreal | 280/47.26 |
| 7,997,211 | B2 * | 8/2011 | Peterson et al. | 108/42 |
| 2004/0026588 | A1 | 2/2004 | Kuhn | |
| 2004/0140742 | A1 * | 7/2004 | Liu | 312/291 |
| 2005/0211863 | A1 * | 9/2005 | Masi | 248/442.2 |
| 2007/0019387 | A1 | 1/2007 | Schipper et al. | |

* cited by examiner

*Primary Examiner* — Janet M Wilkens
*Assistant Examiner* — Timothy M Ayres

(57) ABSTRACT

A compact wall-mountable computer station housing provides storage including a parallelepiped base for holding a flat screen computer monitor, a U-shaped support body integrally attached atop the base for holding a computer printer or a credit card machine, and a utensil tray removably attached to the support body. The housing also includes a swivel wall mount for swivelingly mounting the housing to a vertical surface. A keyboard tray mount attached to a base bottom side allows a computer keyboard to be supported thereon, while a cash drawer which is alternately attached to the base bottom side allows a user to store cash therein.

7 Claims, 5 Drawing Sheets

COMPACT COMPUTER STATION HOUSING

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of mountings and housings for computer equipment are known in the prior art. However, what is needed is compact computer station housing that is portable, wall-mountable, and versatile.

FIELD OF THE INVENTION

The present invention relates to computer equipment mountings and housings, and more particularly, to a compact, portable, wall-mountable computer station housing.

SUMMARY OF THE INVENTION

The general purpose of the present compact computer station housing, described subsequently in greater detail, is to provide a compact computer station housing which has many novel features that result in a compact computer station housing which is not anticipated, rendered obvious, suggested, or even implied by prior art, either alone or in combination thereof.

To accomplish this, the present compact computer station housing provides storage for a computer station including a flat screen computer monitor, a computer printer, and a computer keyboard. The present housing includes a thin parallelepiped base sized to hold a flat screen computer monitor thereon and a U-shaped support body integrally attached thereto, of which two-thirds of a third-wall that stretches across the base is sized to hold a computer printer thereon. A utensil tray is removably attachable to the support body also. The utensil tray permits the storage of office supplies, such as printer rolls and pens. Rectangular apertures disposed in each of the support body third wall and a bottom side of the utensil tray permit the releasable attachment of the computer monitor and computer printer to the housing. Mounting holes are also disposed in each of the base, the support body third wall, and the utensil tray bottom side thereby allowing the computer printer and monitor to be more permanently mounted to the housing. A substantially U-shaped cylindrical handle is also provided to conveniently carry the present housing. A swivel wall mount swivingly removably attached to an underside of the support body third wall is also included in the present housing to permit the housing to be attached to a vertical surface, such as a wall or a wall beam. The present housing also provides a keyboard tray mount removably attached to the base bottom side that permits a computer keyboard to be supported in front of the base. A cash drawer is also provided which is alternately removably attached to the base bottom side which allows the housing to be used as a portable cash bar.

The housing is formed of durable, lightweight materials such as lightweight aluminum. The housing occupies approximately 1.25 cubic feet of space which is optimal for the space-saving housing of a computer station.

An impermeable, weather-proof cover that covers the entire housing while storing a computer monitor and printer may also be provided to protect the computer equipment during inclement weather and from other potentially damaging events. Also, an umbrella may be attached to the handle to protect the computer station and the user from weather conditions such as heat and rain. The housing may also be used to store a credit card machine on either the base or on the support body. A quick cash bar may be established using the housing as well.

The present housing accommodates quick on-site set up and breakdown of a computer station, cash bar, and the like. The housing reduces clutter and potential on-site health and safety hazards and also maximizes space.

Thus has been broadly outlined the more important features of the present compact computer station housing so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
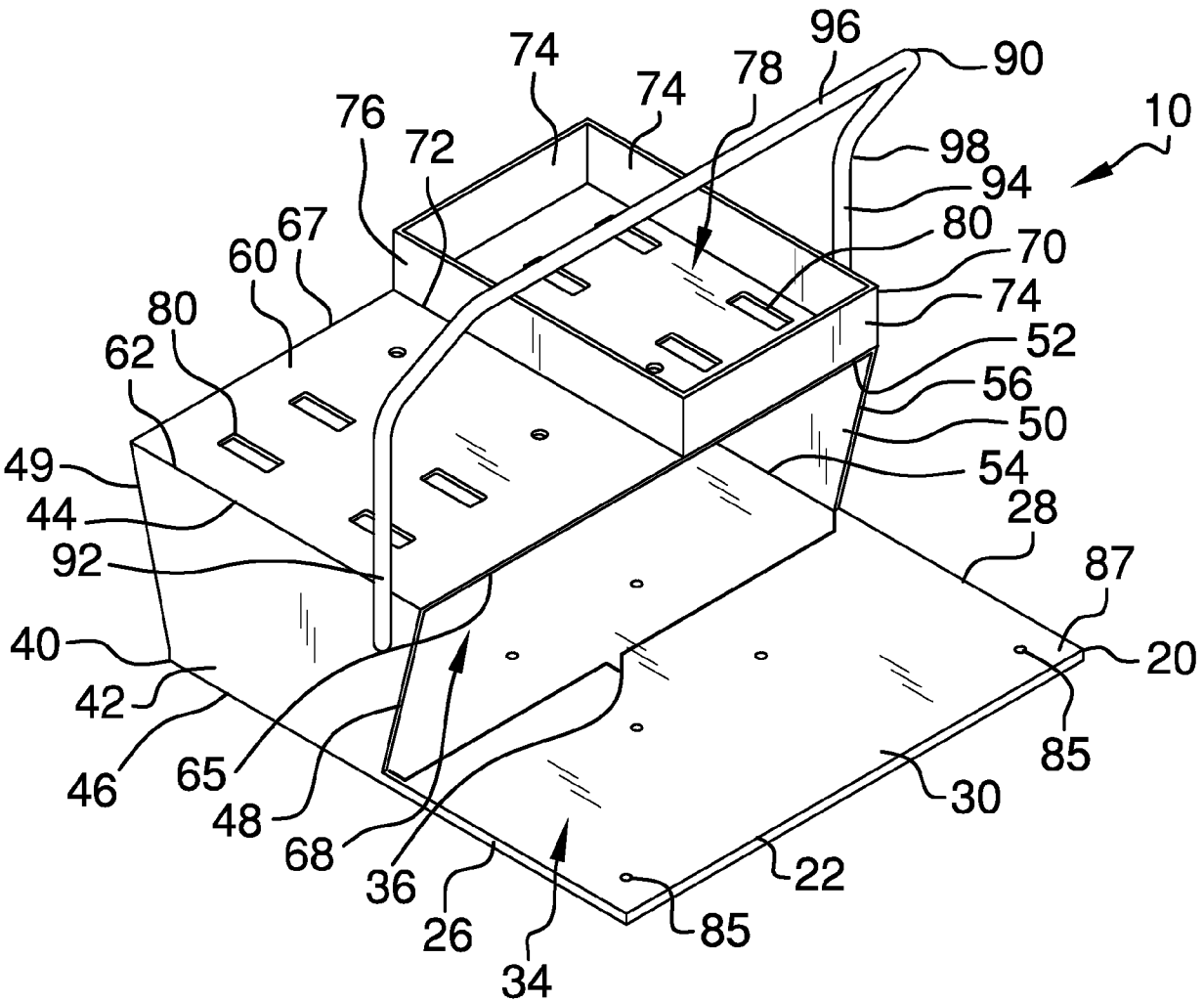
FIG. 1 is an isometric view.
Figure 2:
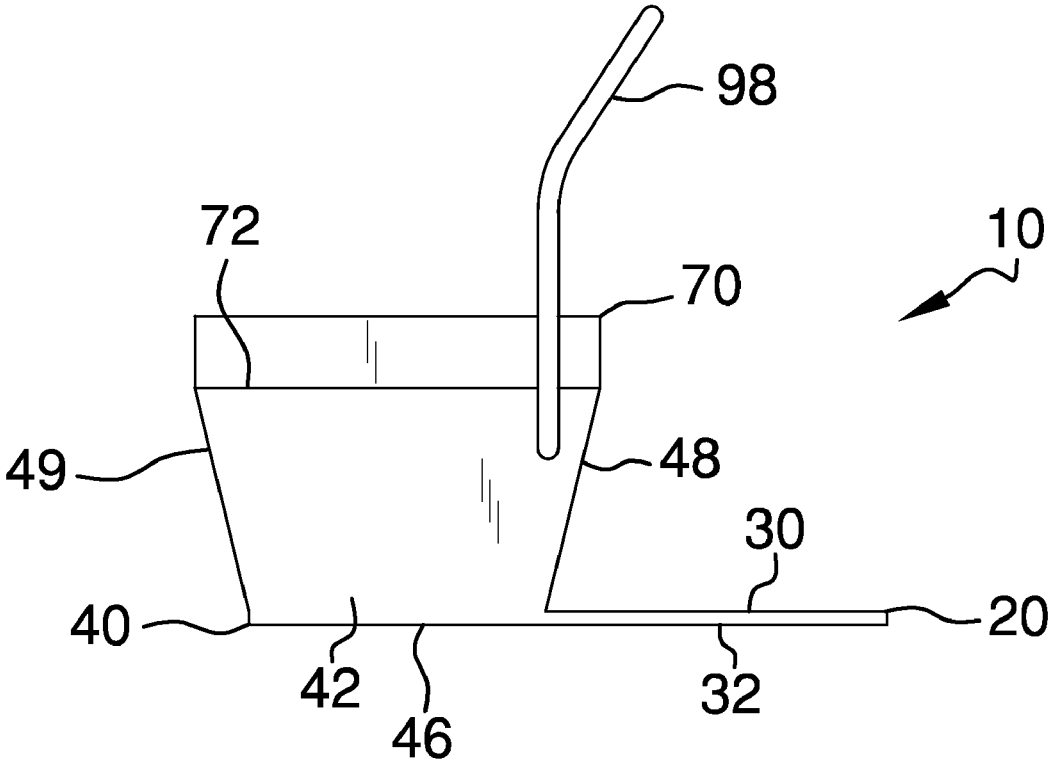
FIG. 2 is a side elevation view.
Figure 3:
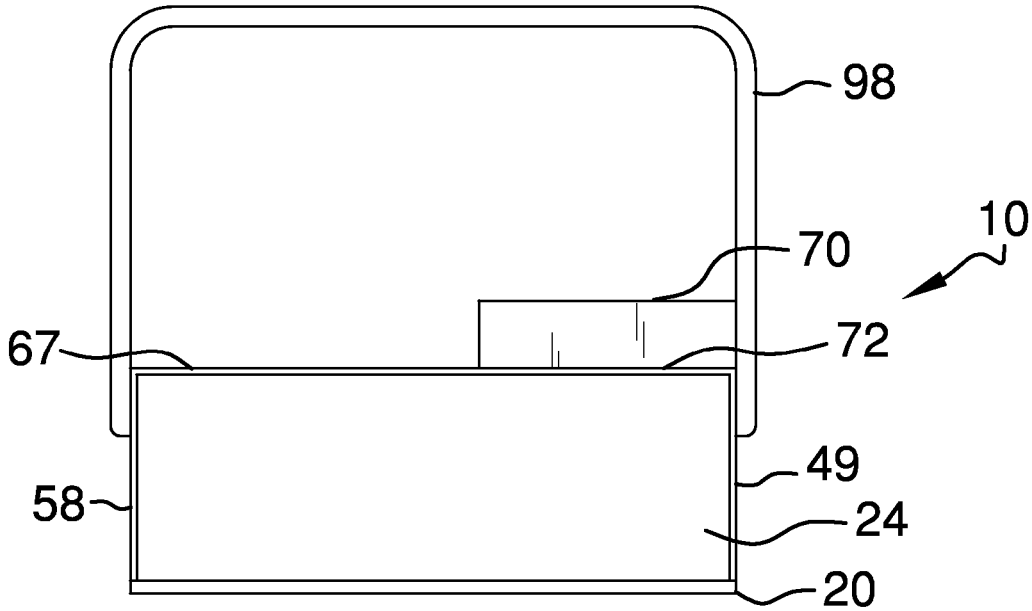
FIG. 3 is a rear elevation view.
Figure 4:
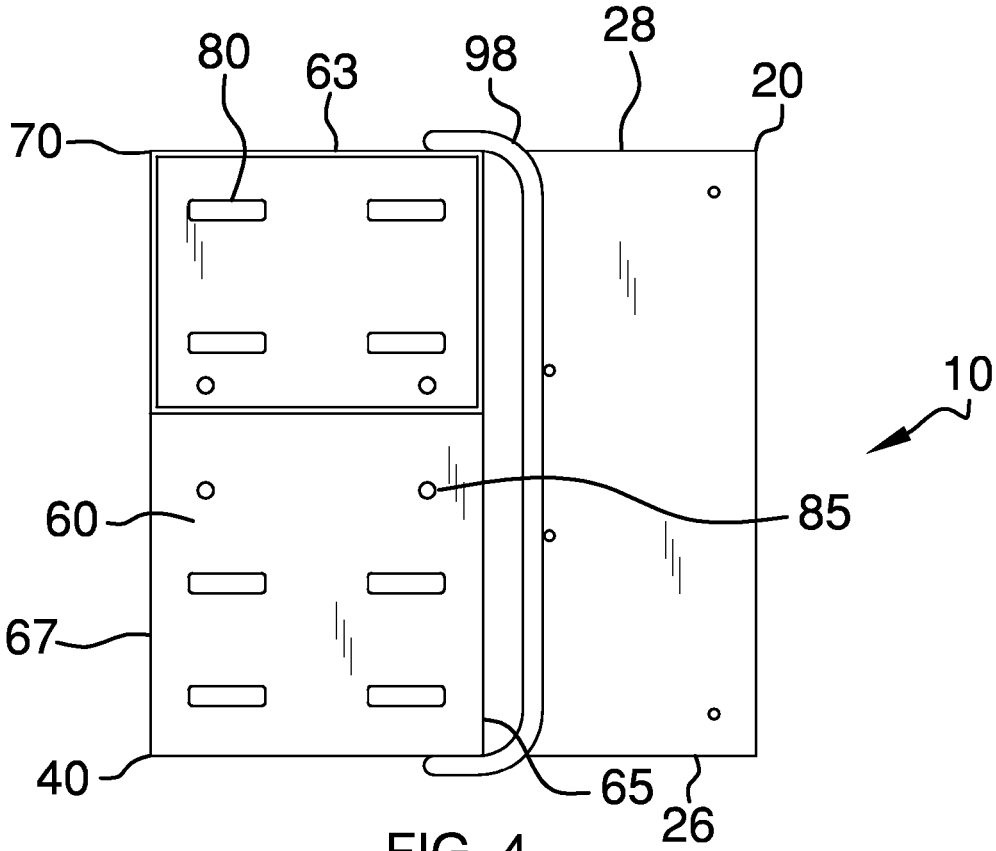
FIG. 4 is a top plan view.
Figure 5:
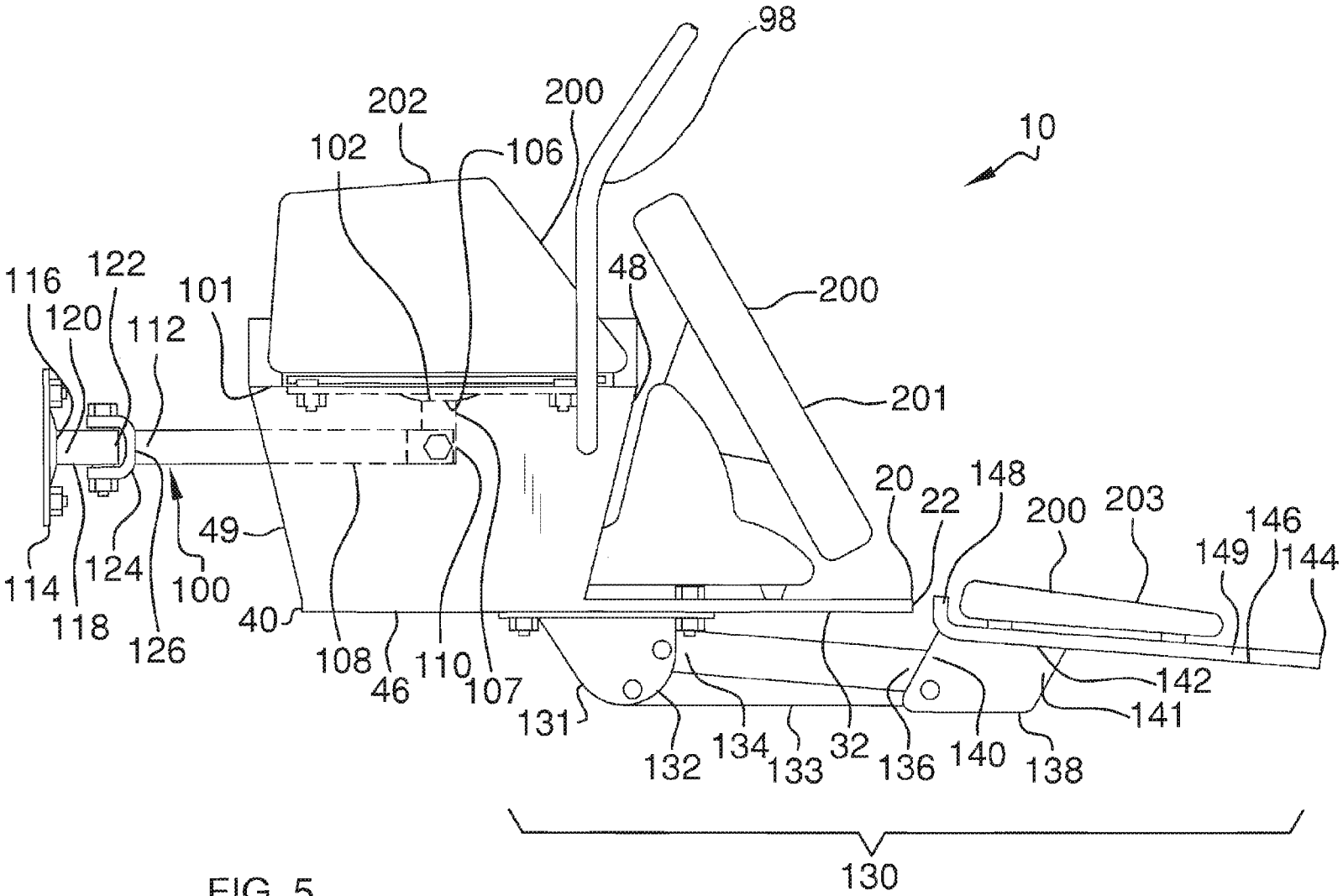
FIG. 5 is an in-use side elevation view.
Figure 6:
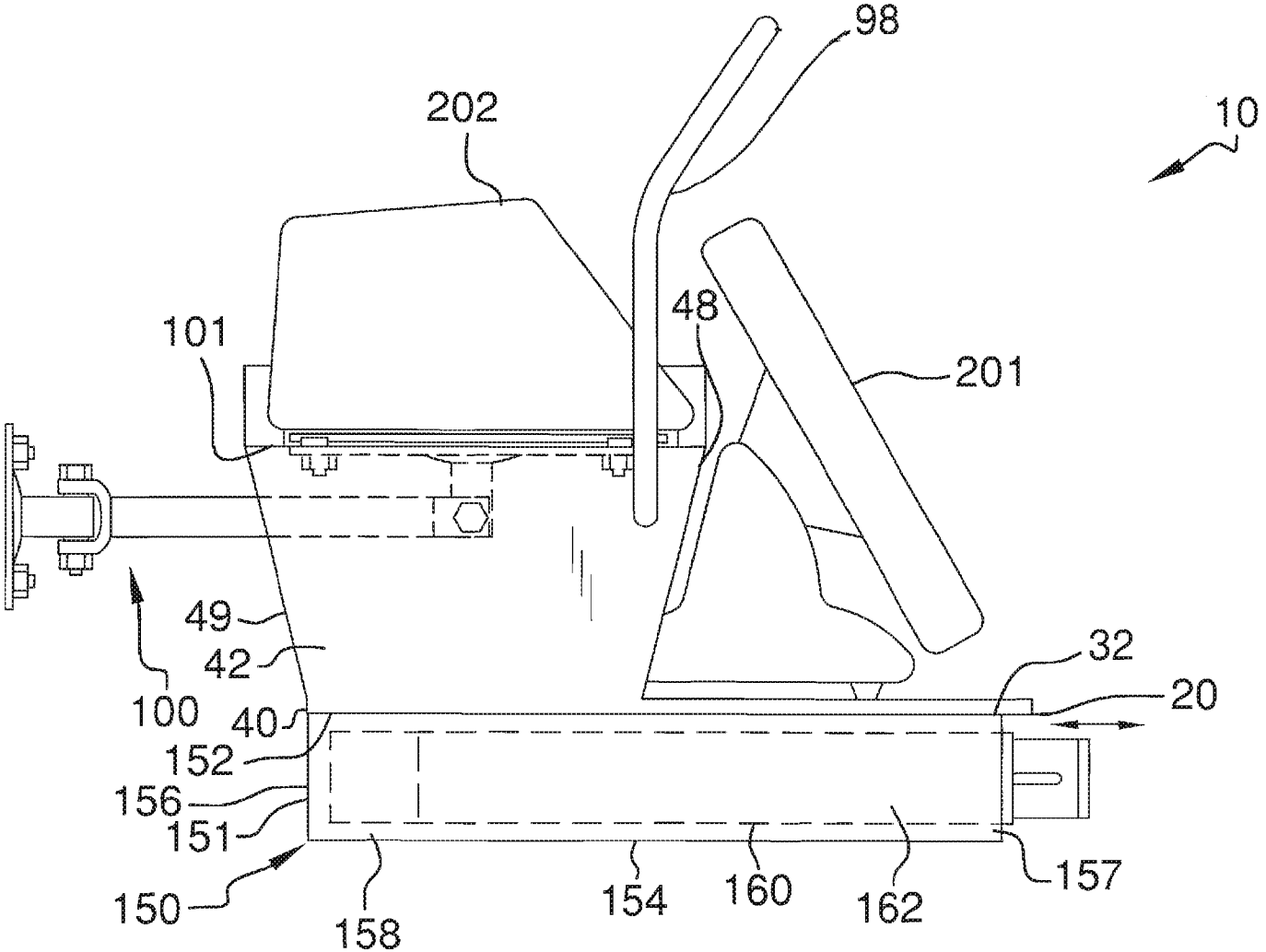
FIG. 6 is an in-use side elevation view including a cash drawer.

With reference now to the drawings, and in particular FIGS. 1 through 6 thereof, example of the instant compact computer station housing employing the principles and concepts of the present compact computer station housing and generally designated by the reference number 10 will be described.

Referring to FIGS. 1 through 6, a preferred embodiment of the present compact computer station housing 10 is illustrated. The housing 10 provides storage for a computer station 200 including a flat screen computer monitor 201, a computer printer 202, and a computer keyboard 203. The present housing 10 includes a thin parallelepiped base 20 having a front end 22, an opposite rear end 24, a first side 26, a opposite second side 28, a top side 30, and an opposite bottom side 32. The base 20 has a front portion 34 and a rear portion 36. The front portion 34 and the rear portion 36 have a substantially same area dimension. The base 20 is sized to hold a flat screen computer monitor 201 thereon.

A substantially U-shaped support body 40 is integrally attached to the base 20 rear portion 36. The support body 40 includes a trapezoidal first wall 42 having a top edge 44, a bottom edge 46 integrally attached to the base 20 first side 26, a front edge 48, and a rear edge 49 proximal to the base 20 rear end 24. The support body 40 also has an opposite trapezoidal second wall 50 having an upper edge 52, a lower edge 54 fixedly attached to the base 20 second side 28, a forward edge 56 centrally disposed on the base 20 second side 28, and a rearward edge 58 proximal to the base 20 rear end 24. A continuous thin parallelepiped third wall 60 has a first side edge 62 fixedly attached to the first wall 42 top edge 44, an opposite second side edge 63 fixedly attached to the second wall 50 upper edge 52, an anterior edge 65, and an opposite posterior edge 67. An internal cavity 68 is continuously disposed between the first wall 42, the second wall 50, the third wall 60, and the base 20. Approximately two-thirds of the third wall is sized to hold a computer printer thereon.

The housing 10 also includes a utensil tray 70. The utensil tray 70 has a bottom side 72 which is removably attached to the support body 40. The utensil tray 70 also has three exterior walls 74, an interior wall 76, and an interior cavity 78. The interior cavity 78 is defined by the exterior walls 74, the interior wall 76, and the bottom side 72.

A plurality of rectangular spaced-apart apertures 80 is disposed in each of the support body 40 third wall 60 and the utensil tray 70 bottom side 72. One-half of the apertures 80 disposed in the support body 40 third wall 60 are disposed proximal to the third wall 60 first side edge 62 and one-half of the apertures 80 are disposed proximal to the third wall 60 second side edge 63 and, further, the apertures 80 are configured in pairs having both vertical and horizontal alignment. The apertures 80 disposed on the utensil tray 70 bottom side 72 are configured in pairs having both vertical and horizontal alignment.

A plurality of spaced-apart mounting holes 85 disposed in each of the base 20, the support body 40 third wall 60, and the utensil tray 70 bottom side 72. A portion of the mounting holes 85 disposed in the base 20 are disposed proximal to each of a base corner 87 and another portion of the mounting holes 85 are centrally disposed in the base 20 configured in pairs having both vertical and horizontal alignment. At least one pair of both vertically and horizontally aligned mounting holes 85 is centrally disposed in the support body 40 third wall 60. The mounting holes 85 disposed in the utensil tray 70 bottom side 72 are disposed in vertical alignment therein proximal to the utensil tray 70 interior wall 76.

The present housing 10 further includes a substantially U-shaped cylindrical handle 90. The handle 90 has a first side bar 92 attached to the first wall 42 proximal to the front edge 48, an opposite second side bar 94 attached to the second wall 50 proximal to the forward edge 56, and a crossbar 96 continuously disposed therebetween. The crossbar 96 is parallel to the third wall 60 anterior edge 65. Each of the first side bar 92 and the second side bar 94 have a slight forward bend 98 therein.

A swivel wall mount 100 swivingly removably attached to an underside 101 of the support body 40 third wall 60 is also included in the present housing 10. The swivel wall mount 100 partially extends through the support body 40 internal cavity 68. The swivel wall mount 100 includes a forward mount body 102 removably centrally attached to the underside 101 of the support body third wall. The forward mount body 102 is disposed perpendicular to the base 20 top side 30. A first extension 107 is attached to a lower side 106 of the forward mount body 102. An elongated first arm 108 has a proximal end 110 attached to the first extension 107 and a distal end 112. The swivel wall mount 100 also includes a first bracket 114 having a forward wall 116. A second arm 118 has an exterior end 120 attached to the first bracket 114 forward wall 116 and an interior end 122. The second arm 118 is disposed in horizontal alignment with the first arm 108. A C-shaped second bracket 124 is swivelingly attached to the second arm 118 interior end 122. The C-shaped second bracket 124 also has a vertical bar 126. The first arm 108 distal end 112 is fixedly attached to the C-shaped second bracket 124 vertical bar 126.

The present housing 10 also provides a keyboard tray mount 130. The keyboard tray mount 130 includes a third bracket 131 removably centrally attached to the base 20 bottom side 32. The third bracket 131 is disposed in a position substantially parallel to the base 20 third wall 60 anterior edge 65. The third bracket 131 has frontal edge 132. An elongated extension arm 133 is a component of the keyboard tray mount 130 and has a rearward end 134 attached to the third bracket 131 frontal edge 132 and a forward end 136. The extension arm 133 is disposed substantially parallel to the base 20 bottom side 32. Further, the extension arm 133 extends forwardly beyond the base 20 front end 22. A fourth bracket 138 has a rear side 140 attached to the extension arm 133 forward end 136, a forward side 141, and an upper side 142. The fourth bracket 138 is disposed in a position substantially parallel to the base 20 front end 22. The keyboard tray mount 130 also includes an elongated substantially L-shaped support member 144 having a bottom wall 146, a first portion 148 disposed in a position parallel to the base 20 front end 22, and a second portion 149. The second portion 149 has a length longer than a length of the first portion 148. The bottom wall 146 of the support member 144 is attached to the fourth bracket 138 upper side 142 proximal to first portion 148. The support member 144 is sized to hold a computer keyboard 203 thereon.

A cash drawer 150 is also provided in the present housing 10. The cash drawer 150 includes an exterior box 151 having an upper wall 152 removably attached to the base 20 bottom side 32, a lower wall 154, a rear wall 156, a pair of side walls 157, and a continuous inside cavity 158 defined by the upper wall 152, the lower wall 154, the rear wall 156, and the side walls 157. The cash drawer 150 also includes an interior box 160 slidingly engaging the inside cavity 158. The interior box 160 has an inner cavity 162 for holding items, such as cash.

What is claimed is:

1. A compact housing for storing a computer station including a flat screen computer monitor, a computer printer, and a computer keyboard, the housing comprising:

a thin parallelepiped base having a front end, an opposite rear end, a first side, a opposite second side, a top side, and an opposite bottom side, the base further comprising a front portion and a rear portion;

a substantially U-shaped support body attached to the base rear portion, the support body comprising:

a trapezoidal first wall having a top edge, a bottom edge fixedly attached to the base first side, a front edge, and a rear edge proximal to the base rear end;

an opposite trapezoidal second wall having an upper edge, a lower edge fixedly attached to the base second side, a forward edge centrally disposed on the base second side, and a rearward edge proximal to the base rear end;

a continuous thin parallelepiped third wall having a first side edge fixedly attached to the first wall top edge, an opposite second side edge fixedly attached to the second wall upper edge, an anterior edge, and an opposite posterior edge;

an internal cavity continuously disposed between the first wall, the second wall, the third wall, and the base;

a utensil tray having a bottom side removably attached to the support body, three exterior walls, an interior wall, and an interior cavity defined by the exterior walls, the interior wall, and the bottom side;

a plurality of rectangular spaced-apart apertures disposed in each of the support body third wall and the utensil tray bottom side;

a plurality of spaced-apart mounting holes disposed in each of the base, the support body third wall, and the utensil tray bottom side;

a substantially U-shaped cylindrical handle having a first side bar attached to the first wall proximal to the front edge, an opposite second side bar attached to the second wall proximal to the forward edge, and a crossbar continuously disposed therebetween, wherein the crossbar is parallel to the third wall anterior edge, wherein each of the first side bar and the second side bar have a slight forward bend therein;

a swivel wall mount swivingly removably attached to an underside of the support body third wall, the swivel wall mount partially extending through the support body internal cavity;

wherein the base is sized to hold a flat screen computer monitor thereon;

wherein approximately two-thirds of the support body third wall is sized to hold a computer printer thereon.

2. The housing of claim 1 wherein the swivel wall mount further comprises:

a forward mount body removably centrally attached to an underside of the support body third wall, the forward mount body disposed perpendicular to the base top side;

a first extension attached to a lower side of the forward mount body;

an elongated first arm having a proximal end attached to the first extension and a distal end;

a first bracket having a forward wall;

a second arm having an exterior end attached to the first bracket forward wall and an interior end, the second arm disposed in horizontal alignment with the first arm; and a C-shaped second bracket swivelingly attached to the second arm interior end, the C-shaped second bracket having a vertical bar, wherein the first arm distal end is fixedly attached to the C-shaped second bracket vertical bar.

3. The housing of claim 2 further comprising a keyboard tray mount comprising:

a third bracket removably centrally attached to the base bottom side, the third bracket disposed in a position substantially parallel to the base third wall anterior edge, the third bracket having a frontal edge;

an elongated extension arm having a rearward end attached to the third bracket frontal edge and a forward end, wherein the extension arm is disposed substantially parallel to the base bottom side, and further wherein the extension arm extends forwardly beyond the base front end;

a fourth bracket having a rear side attached to the extension arm forward end, a forward side, and an upper side, the fourth bracket disposed in a position substantially parallel to the base front end;

an elongated substantially L-shaped support member having a bottom wall, a first portion disposed in a position parallel to the base front end, a second portion having a length longer than a length of the first portion, wherein the bottom wall is attached to the fourth bracket upper side proximal to first portion;

wherein the support member is sized to hold a computer keyboard thereon.

4. The housing of claim 2 further comprising a cash drawer comprising:

an exterior box having an upper wall removably attached to the base bottom side, a lower wall, a rear wall, a pair of side walls, and a continuous inside cavity defined by the upper wall, the lower wall, the rear wall, and the side walls; and an interior box slidingly engaging the inside cavity, the interior box having an inner cavity.

5. The housing of claim 2 wherein one-half of the apertures disposed in the support body third wall are disposed proximal to the third wall first side edge and one-half of the apertures are disposed proximal to the third wall second side edge, wherein the apertures are configured in pairs having both vertical and horizontal alignment;

wherein the apertures disposed on the utensil tray bottom side are configured in pairs having both vertical and horizontal alignment;

wherein a portion of the mounting holes disposed in the base are disposed proximal to each of a base corner and another portion of the mounting holes are centrally disposed in the base configured in pairs having both vertical and horizontal alignment;

wherein the mounting holes disposed in support body third wall comprise at least one pair of both vertically and horizontally aligned mounting holes centrally disposed therein; and wherein the mounting holes disposed in the utensil tray bottom side are disposed in vertical alignment therein proximal to the utensil tray interior wall.

6. The housing of claim 3 wherein one-half of the apertures disposed in the support body third wall are disposed proximal to the third wall first side edge and one-half of the apertures are disposed proximal to the third wall second side edge, wherein the apertures are configured in pairs having both vertical and horizontal alignment;

wherein the apertures disposed on the utensil tray bottom side are configured in pairs having both vertical and horizontal alignment;

wherein a portion of the mounting holes disposed in the base are disposed proximal to each of a base corner and another portion of the mounting holes are centrally disposed in the base configured in pairs having both vertical and horizontal alignment;

wherein the mounting holes disposed in support body third wall comprise at least one pair of both vertically and horizontally aligned mounting holes centrally disposed therein; and wherein the mounting holes disposed in the utensil tray bottom side are disposed in vertical alignment therein proximal to the utensil tray interior wall.

7. The housing of claim 4 wherein one-half of the apertures disposed in the support body third wall are disposed proximal to the third wall first side edge and one-half of the apertures are disposed proximal to the third wall second side edge, wherein the apertures are configured in pairs having both vertical and horizontal alignment;

wherein the apertures disposed on the utensil tray bottom side are configured in pairs having both vertical and horizontal alignment;

wherein a portion of the mounting holes disposed in the base are disposed proximal to each of a base corner and another portion of the mounting holes are centrally disposed in the base configured in pairs having both vertical and horizontal alignment;

wherein the mounting holes disposed in support body third wall comprise at least one pair of both vertically and horizontally aligned mounting holes centrally disposed therein; and wherein the mounting holes disposed in the utensil tray bottom side are disposed in vertical alignment therein proximal to the utensil tray interior wall.

* * * * *